US005841232A

United States Patent [19]

Hirao et al.

[11] Patent Number: 5,841,232

[45] Date of Patent: Nov. 24, 1998

[54] AC PLASMA DISPLAY PANEL

[75] Inventors: Kazunori Hirao; Toru Hirayama; Koji Aoto, all of Osaka, Japan

[73] Assignee: Matsushita Electronics Corporation, Osaka, Japan

[21] Appl. No.: 833,759

[22] Filed: Apr. 9, 1997

[30] Foreign Application Priority Data

Apr. 17, 1996 [JP] Japan ..... 8-095703

[51] Int. Cl.[6] ..... H01J 17/49

[52] U.S. Cl. ..... 313/585; 313/632

[58] Field of Search ..... 313/484, 485, 313/582, 583, 584, 585, 586, 6.31, 6.32; 345/60; 315/169.4

[56] References Cited

U.S. PATENT DOCUMENTS 5,656,893 8/1997 Shino et al. ..... 313/582
5,684,499 11/1997 Shimizu et al. ..... 345/60

FOREIGN PATENT DOCUMENTS 4-332430 11/1992 Japan ..... H01J 17/49
7-111134 4/1995 Japan ..... H01J 11/02

*Primary Examiner*—Sandra O'Shea
*Assistant Examiner*—Michael Day
*Attorney, Agent, or Firm*—Merchant, Gould, Smith, Edell, Welter & Schmidt, P.A.

[57] ABSTRACT

An AC plasma display panel includes a plurality of opaque scanning electrodes (3*b*, 3*c*) and maintaining electrodes (4*b*, 4*c*) which are parallel to each other, formed on a first glass substrate (1) at the display side of the display, a plurality of ribs (9) formed on a second glass substrate (7) and arranged orthogonally to the scanning and maintaining electrodes, a data electrode (8) formed on the second glass substrate (7), positioned between the ribs and arranged parallel to the ribs (9), wherein a discharge cell (2) is defined by dividing the space between two ribs (9) and includes at least two of the scanning electrodes (3*b*, 3*c*) and at least two of the maintaining electrodes (4*b*, 4*c*). The maintaining discharge is generated between the two scanning electrodes (3*b*, 3*c*) and the two maintaining electrodes (4*b*, 4*c*). Consequently, a discharge region can be widened without decreasing the opening ratio, and an AC plasma display panel with high brightness and high efficiency can be obtained. In addition, because the display does not required to use electrodes in which a transparent conductor and a bus electrode are connected electrically, both the number of production steps and the cost of production can be decreased.

13 Claims, 15 Drawing Sheets

AC PLASMA DISPLAY PANEL

FIELD OF THE INVENTION

The present invention relates to an AC plasma display panel by which an image display of television or an advertising display board is obtained.

BACKGROUND OF THE INVENTION

Referring to FIGS. 10–15, a first example of conventional AC plasma display panel will be explained. As shown in FIG. 10, a discharge cell 2 comprises a pair of electrodes consisting of a scanning electrode 3 and a maintaining electrode 4 that are parallel to each other and formed on a first glass substrate 1. The scanning electrode 3 and the maintaining electrode 4 are covered with a dielectric layer 5 and a protective film layer 6. On a second glass substrate 7, which is facing the first glass substrate 1, a plurality of ribs 9 are arranged orthogonally to the scanning electrode 3 and the maintaining electrode 4. A data electrode 8 is arranged parallel to and between two ribs 9. On the surface of the second glass substrate 7 and the data electrode 8 positioned between the ribs 9, a phosphor layer 10 is provided. A discharge space 11, which is surrounded by the glass substrate 1, the second substrate 7 and ribs 9, is formed. In the discharge space, a discharge cell 2, which is a region where a pair of electrodes consisting of a scanning electrode 3 and a maintaining electrode 4 and two ribs 9 are crossing each other, is formed. A scanning electrode 3, a maintaining electrode 4 and the data electrode 8 are composed of Ag or a laminated conductor in which a Cu layer is sandwiched by Cr layers. The dielectric layer 5 is composed of borosilicate glass and the like, and the protective film layer 6 is composed of MgO and the like. In the discharge space, at least one discharge noble gas such as helium, neon, argon, xenon and the like is sealed.

FIG. 11 is a sectional view of a discharge cell taken on line XI—XI of FIG. 10. Referring to FIG. 11, the operation of the discharge luminescence display will be explained. In performing a writing operation, a positive write pulse voltage is applied to a data electrode 8 and a negative scanning pulse voltage is applied to a scanning electrode 3. Consequently, a write discharge is generated in the discharge space 11, and therefore a positive electrical charge is stored on a surface of a protective film layer 6 formed on the scanning electrode 3. After the above-mentioned operation, a negative pulse voltage is applied to a maintaining electrode 4, and consequently a maintaining discharge is excited by the positive electrical discharge generated on the surface of the protective film layer 6 formed on the scanning electrode 3. After that, the maintaining charge is continued by applying a negative pulse voltage to the scanning electrode 3 and the maintaining electrode 4 alternately. The maintaining discharge is ceased by applying a negative erasing pulse voltage to the maintaining electrode 4.

As shown in FIG. 11, the maintaining discharge is generated at a limited region S with a comparatively strong electric field. Ultraviolet rays emitted from the region S excite a phosphor layer 10, then a visible light emitted from the phosphor layer 10 passes externally through the first glass substrate 1 as shown by dotted lines in FIG. 11. In this case, when the distance W between the scanning electrode 3 and the maintaining electrode 4 is widened, the maintaining discharge region S is widened, and as a result, the amount of ultraviolet rays is increased. The luminous efficiency of the maintaining discharge can be improved, however, the maintaining discharge voltage is also increased considerably with the great increase of the amount of the ultraviolet rays. Therefore the distance W between the scanning electrode 3 and the maintaining electrode 4 is set in a range between 20 $\mu$m and 200 $\mu$m, taking into consideration the requirements for practical use.

Next, a proper value for the width of the scanning electrode 3 and the maintaining electrode 4 will be explained. FIG. 12 is a sectional view in which the width of each electrode $d_0$ as shown in FIG. 11 is widened. As shown in FIG. 12, when the widths of the scanning electrode 3 and the maintaining electrode 4 $d_0$ are widened, a maintaining discharge region S in a discharge cell 2 is widened, as a result, a large amount of ultraviolet rays is obtained. Consequently, the amount of visible light emitting from the phosphor layer 10 is increased. However, when the width of electrode $d_0$ is widened, the area where visible light emitting from a phorphor layer 10 is interrupted by the scanning electrode 3 and the maintaining electrode 4 is increased. Consequently, the opening ratio which is the ratio of an area where a visible light passes to an area of discharge cell, is reduced. Therefore, when the width of electrode $d_0$ exceeds a certain amount, the brightness is reduced conversely.

FIG. 13 is a graph showing the relationship between the width of scanning electrode 3 and maintaining electrode 4, shown as $d_0$, the amount of ultraviolet rays shown as u, opening ratio of panel shown as A and the brightness of the panel shown as B. The scale used in FIG. 13 is a relative scale, and the maximum value of B, A and u respectively is 1. As shown in FIG. 13, as the width of an electrode $d_0$ is widened, the amount of ultraviolet rays is increased, therefore a brightness B is increased with the increase of the amount of ultraviolet rays. However, when the width of the electrode $d_0$ exceeds a certain amount, the brightness B is reduced by an influence of the reduction of the opening ratio A. As shown in FIG. 13, when the width of an electrode $d_0$ is dm, the brightness B becomes maximum. Therefore the width of the scanning electrode 3 and the maintaining electrode 4 $d_0$ are set to be dm. When W is in a range between 20 $\mu$m and 200 $\mu$m and the width of a discharge cell is shown as p, dm satisfies two conditions, such as dm+W is in a range between 200 $\mu$m and 2000 $\mu$m, and dm is in a range between p/5 and p/3.

Next, a second example of a conventional AC plasma display panel will be explained referring to FIGS. 14 and 15. A scanning electrode 3 and a scanning electrode bus 3*a* are connected electrically. In the same way, a maintaining electrode 4 and a maintaining electrode bus 4*a* are also connected electrically. The scanning electrode 3 and the maintaining electrode 4 are composed of a transparent conductor such as ITO or $SnO_2$. The scanning electrode bus 3*a*, the maintaining electrode bus 4*a* and a data electrode 8 are composed of Ag or a laminated conductor in which a Cu layer is sandwiched by Cr layers. The other aspects of the construction and operation as plasma display panel are the same as those of the first example and therefore an explanation about these is omitted.

FIG. 15 is a sectional view of a discharge cell 2 taken on line XV—XV of FIG. 14. The scanning electrode 3 and the maintaining electrode 4 are composed of a transparent conductor. Therefore, as shown by dotted lines in FIG. 15, a visible light emitting from the phosphor layer 10 passes through those electrodes easily. Consequently, even if the width of the scanning electrode 3 and the maintaining electrode 4 $d_1$ is widened, the area, where a visible light passes through, is not changed, and as a result, the opening ratio is maintained to be constant. Therefore, the maintaining discharge region S can be widened without decreasing the opening ratio. As a result, a decrease of brightness due to a decrease of the opening ratio can be prevented and the luminous efficiency of the maintaining discharge can be improved.

In the first example of the conventional AC plasma display panel, the maintaining discharge region S can be widened and the amount of ultraviolet rays can be increased by widening a width of an electrode $d_0$. However, when the width of an electrode exceeds a certain amount, the brightness is decreased conversely by the effect of the decrease of the opening ratio. Consequently, there is a certain limitation to achieve a high brightness and high efficiency.

In the second example of the conventional AC plasma display panel, the above-mentioned problems of the first example are solved. However, it is required to form a scanning electrode 3 and a maintaining electrode 4 composed of a transparent conductor in addition to a scanning electrode bus 3*a* and a maintaining electrode bus 4*a*. Therefore, the number of production process steps is increased and the cost of production is also increased.

SUMMARY OF THE INVENTION

This invention aims to solve the above-mentioned problems and provide an AC plasma display panel in which a high brightness and a high efficiency can be obtained without increasing the number of production process steps and the cost of production.

An AC plasma display panel of this invention comprises a pair of glass substrates which are facing each other and have a discharge space therebetween, a plurality of scanning electrodes and maintaining electrodes which are parallel to each other and formed on a first glass substrate, a dielectric layer which covers the scanning electrodes and the maintaining electrodes, a plurality of ribs which are formed on the second glass substrate and arranged orthogonally to the scanning electrodes and the maintaining electrodes, and a data electrode which is formed between each rib on the second glass substrate and arranged parallel to the ribs. In the AC plasma display panel, a discharge cell, which is formed by dividing the discharge space with two ribs, comprises a plurality of scanning electrodes and maintaining electrodes.

According to the AC plasma display panel, a plurality of scanning electrodes and maintaining electrodes are provided in a discharge cell, therefore the discharge region can be widened without decreasing the opening ratio. Therefore, an AC model plasma display panel with a high brightness and high efficiency can be obtained without increasing the number of production process steps and the cost of the production.

In the AC plasma display panel, it is preferable that a pair or a plurality of pairs of electrodes, consisting of a plurality of scanning electrodes provided at one side of each discharge cell and of a plurality of maintaining electrodes whose number is the same as that of the scanning electrodes provided at another side of each discharge cell, are provided.

In the above-mentioned preferable AC plasma display panel, it is preferable that the distance W between an end of a scanning electrode in a crosswise direction and an end of a maintaining electrode, which is adjacent, is in a range between 20 $\mu$m and 200 $\mu$m. When the distance is in the range, the luminous efficiency of the maintaining discharge can be improved without increasing the maintaining discharge voltage.

In the above-mentioned preferable AC plasma display panel, wherein the distance W is in a range between 20 $\mu$m and 200 $\mu$m, when a pair of electrodes comprises four electrodes, the width of each electrode is shown as d, and the width of a discharge cell is shown as p, it is preferable that 2d satisfies two conditions, such as 2d+W is in a range between 200 $\mu$m and 2000 $\mu$m, and 2d is in a range between p/5 and p/3.

In the above-mentioned preferable AC plasma display panel, wherein a pair of electrodes comprises four electrodes, the distance between an end of one scanning electrode and an end of another electrode which is adjacent in a crosswise direction is shown as g, g satisfies two conditions, such as d+g is in a range between 200 $\mu$m and 2000 $\mu$m, and g is in a range between d/2 and d. When the width of an electrode d and the distance g are in the above-mentioned range, the luminous brightness becomes maximum.

In the AC plasma display panel, a discharge cell comprises a plurality of pairs of electrodes consisting of a scanning electrode and a maintaining electrode. In this case, the position of the scanning electrode and the maintaining electrode are arranged alternately.

According to the AC plasma display panel, the discharge region can be widened without decreasing opening ratio. Therefore, an AC plasma display panel having a high brightness and high efficiency can be obtained without increasing the number of production process steps and the cost of production.

In the above-mentioned preferable AC plasma display panel, wherein a plurality of pairs of electrodes consisting of a scanning electrode and a maintaining electrode are arranged, it is preferable that the distance W between an end of a scanning electrode and an end of a maintaining electrode which is adjacent in a crosswise direction is in a range between 20 $\mu$m and 200 $\mu$m. When the distance is in this range, the luminous efficiency of the maintaining discharge can be improved without increasing the maintaining discharge voltage.

In the above-mentioned preferable AC plasma display panel, wherein the distance W is in a range between 20 $\mu$m and 200 $\mu$m, it is preferable that two pairs of electrodes are provided at a discharge cell, and when a width of each electrode is shown as d, and a width of a discharge cell is shown as p, it is preferable that 2d satisfies two conditions, such as 2d+W is in a range between 200 $\mu$m and 2000 $\mu$m, and 2d is in a range between p/5 and p/3.

In the above-mentioned preferable AC plasma display panel, wherein a discharge cell comprises two pairs of electrodes, it is preferable that an inside distance h between an end of a scanning electrode in a crosswise direction, and an end of a maintaining electrode which is adjacent is in a range between (d+W)/3 and (d+W)/2. When the width of an electrode d and the distance h are in the above-mentioned range, the brightness becomes maximum.

In the above-mentioned AC plasma display panel, it is preferable that a pair or a plurality of pairs of electrodes comprising two scanning electrodes arranged at outside and two maintaining electrodes arranged at the inside are provided in a discharge cell. In this case, an arrangement of electrodes may be reversed, that is, two maintaining electrodes are arranged at outside and two scanning electrodes are arranged at the inside.

It is preferable that a pair or a plurality of pairs of electrodes consisting of a plurality of scanning electrodes are arranged at one side of a discharge cell and the same number of maintaining electrodes as those of scanning electrodes are arranged at another side of the discharge cell.

It is preferable that a plurality of induction electrodes which connect electrically with a plurality of scanning electrodes are arranged at one side of the discharge cell at a position of rib and a plurality of induction electrodes which connect electrically with the plurality of maintaining electrodes are arranged at another side of the discharge cell at a position of rib, and one portion of those induction electrodes are exposed to a discharge space.

According to the explanation, the decrease of brightness at an initial stage of discharge and the irregularity on the display panel can be prevented by connecting the scanning electrodes and the maintaining electrodes electrically via induction electrodes.

It is preferable that the scanning electrode, the maintaining electrode and the data electrode are composed of Ag or a laminated conductor in which a Cu layer is sandwiched by Cr layers. It is also preferable that a noble gas is sealed in the discharge space as a discharge gas.

DETAILED DESCRIPTION OF THE INVENTION

Figure 1:
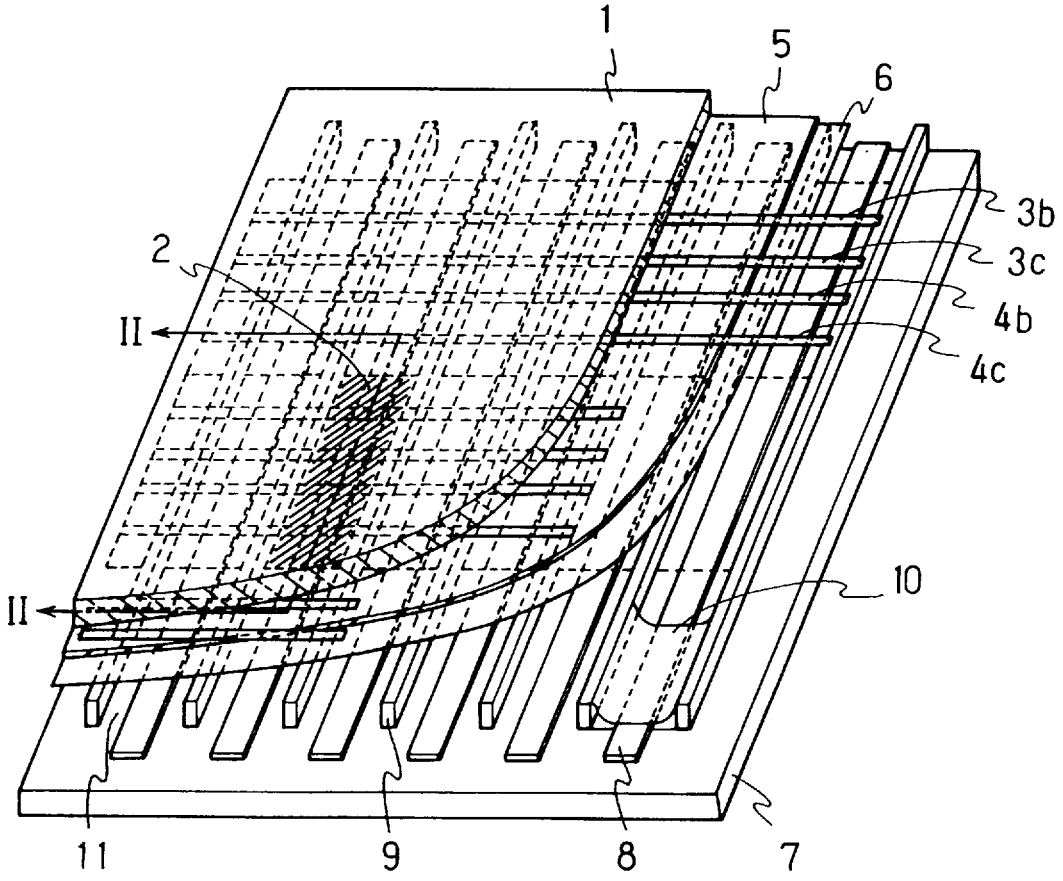
FIG. 1 is a perspective view showing a first embodiment of an AC plasma display panel of this invention.

A first example of an AC plasma display panel of this invention will be explained referring to FIGS. 1 to 3. In FIG. 1, a discharge cell 2 comprises four electrodes formed on a first glass substrate 1. Two of them are scanning electrodes 3*b* and 3*c* provided at one side, and the other two of them are maintaining electrodes 4*b* and 4*c* provided at another side. These electrodes are covered with a dielectric layer 5 and a protective film layer 6. On a second glass substrate 7 facing the first glass substrate 1, a plurality of ribs 9 are arranged orthogonally to the scanning electrode 3*b* and 3*c* and the maintaining electrodes 4*b* and 4*c*. A data electrode 8 is arranged between two ribs 9 formed on the surface of the second glass substrate 7 and is parallel to the ribs. A phosphor layer 10 is formed between these two ribs on the surface of the data electrode 8. A discharge space 11 is defined by a first glass substrate 1, a second glass substrate 7, and ribs 9. In the discharge space, a discharge cell 2 is formed, where a pair of electrodes consisting of a scanning electrode 3*b* and 3*c*, a maintaining electrode 4*b* and 4*c*, and two ribs are crossing. A scanning electrode 3*b* and 3*c*, a maintaining electrode 4*b* and 4*c* and a data electrode 8 are composed of Ag or a laminated conductor in which a Cu layer is sandwiched by Cr layers. A dielectric layer 5 is composed of borosilicate glass and the like, and a protective film layer 6 is composed of MgO and the like. At least one of a noble gas such as helium, neon, argon or xenon is sealed in the discharge space 11.

Figure 2:
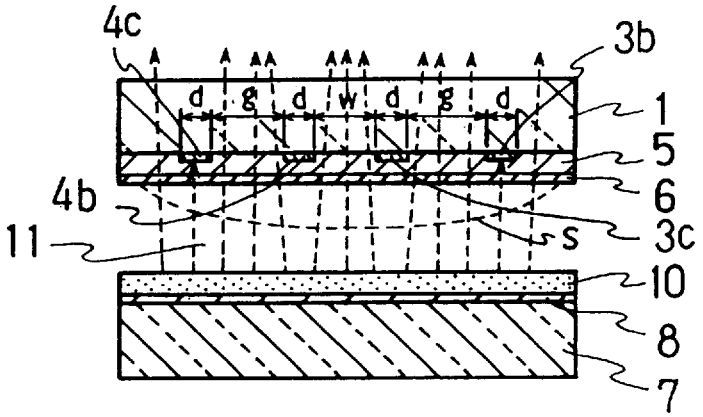
FIG. 2 is a sectional view taken on line II—II of FIG. 1.

FIG. 2 is a sectional view of a discharge cell 2 taken on line II—II of FIG. 1. Referring to FIG. 2, the operation of discharge luminescence display will be explained. In performing a writing operation, a positive write pulse is applied to a data electrode 8 and a negative scanning pulse voltage is applied to a scanning electrode 3*b* and 3*c*. Consequently, a write discharge is occured in discharge space 11, and therefore a positive electrical charge is stored on the surface of a protective film layer 6 formed on the scanning electrode 3*b* and 3*c*. After the above-mentioned operation, a negative maintaining pulse voltage is applied to maintaining electrodes 4*b* and 4*c*, and consequently a maintaining discharge is excited by the positive electrical discharge generated on the surface of the protective film layer 6 formed on the scanning electrodes 3*b* and 3*c*. After that, the maintaining discharge is continued by applying a negative maintaining pulse voltage to the scanning electrodes 3*b* and 3*c* and the maintaining electrodes 4*b* and 4*c* alternately. The maintaining discharge is ceased by applying a negative erasing pulse voltage to the maintaining electrode 4*b* and 4*c*.

Figure 11:
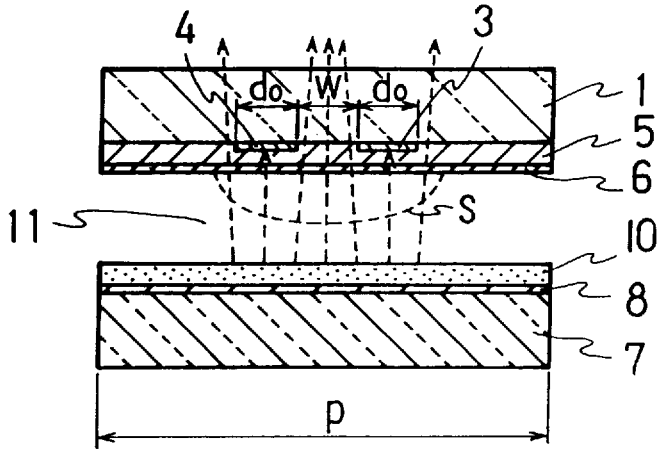
FIG. 11 (PRIOR ART)
FIG. 11 is a sectional view taken on line XI—XI of FIG. 10.

As shown in FIG.2, the maintaining discharge is generated between two scanning electrodes 3*b* and 3*c*, and two maintaining electrodes 4*b* and 4*c*. In this case, when a width of each electrode d is set to be half of a width of an electrode of conventional case, that is, $d_0/2$, a distance W between a scanning electrode 3*c* and a maintaining electrode 4*b* is identical to that of the conventional case, and a distance between each scanning electrode and between each maintaining electrode is set to be g, the distance between the right side end of the scanning electrode 3*b* and the left side end of the maintaining electrode 4*c* as shown in FIG. 2 is widened, that is, a length of 2×g is added to the distance of the conventional example as shown in FIG. 11.

As above-mentioned, a maintaining discharge region S of this embodiment of this invention is widened, that is, a length of 2×g is added, in comparison with the maintaining discharge region S of the conventional example. Consequently, the widened discharge region is equivalent to a discharge region between a scanning electrode whose width is the sum of $d_0$ and g and a maintaining electrodes whose width is the sum of $d_0$ and g. According to the embodiment of this invention, the area of the electrode which interrupts a visible light is the same as that of the conventional example, therefore the opening ratio becomes the same as that of the conventional type. As a result, according to the embodiment of this invention, a discharge region S can be widened without decreasing the opening ratio, and therefore a brightness can be improved. In addition to that, it is not required to use an electrode in which a transparent conductor and an electrode bus are connected electrically. Consequently, the number of production process steps and the cost of production can be decreased.

Hereinafter, more details of the embodiment will be explained concretely. As explained in the conventional example, when a distance W between a scanning electrode 3*c* and a maintaining electrode 4*b* is widened, a luminous efficiency of the maintaining discharge can be improved. However, at the same time, a maintaining discharge voltage is increased considerably. Therefore, the distance W is set to be in a range between 20 μm and 200 μm, taking into consideration the requirements of practical use.

Next, a proper value of a width of a scanning electrode 3*b* and 3*c*, a maintaining electrode 4*b* and 4*c* and a distance between each electrode will be explained. The width d of a scanning electrode 3*b* and 3*c*, a maintaining electrode 4*b* and 4*c*, of an AC plasma display panel is set to be dm/2 to compare with a conventional example of AC plasma display panel under the same conditions. When a width d of an electrode is set as above-mentioned, dm/2×4 is equivalent to dm×2, and a ratio of visible light, emitting from a phosphor layer 10, which is interrupted by a width of the scanning electrode 3*b* and 3*c*, the maintaining electrode 4*b* and 4*c* becomes the same, that is the opening ratio of the panel becomes the same as that of the conventional example.

Figure 12:
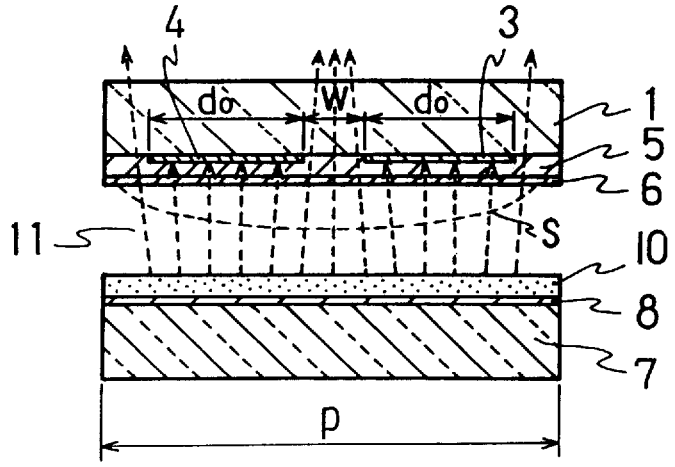
FIG. 12 (PRIOR ART)
FIG. 12 is a sectional view, in which the width of an electrode shown in FIG. 11 is widened.

As shown in FIG. 2, when the distance g between the scanning electrodes 3*b* and 3*c*, and between the maintaining electrodes 4*b* and 4*c* is widened, the discharge condition becomes the same as a case in which a width of a scanning electrode and a maintaining electrode is widened as shown in FIG. 12. As a result, the maintaining discharge region S in the discharge cell 2 is widened, a large amount of ultraviolet rays can be obtained, and consequently, the amount of visible light emitted from phosphor layer 10 is increased. In this case, the ratio of the visible light which is interrupted by the width of scanning electrodes 3*b* and 3*c* and maintaining electrodes 4*b* and 4*c* is the same as that of conventional example even if the distance g is widened. Therefore, the opening ratio A of the panel is constant, and a brightness is increased with an extension of the region S.

Figure 3:
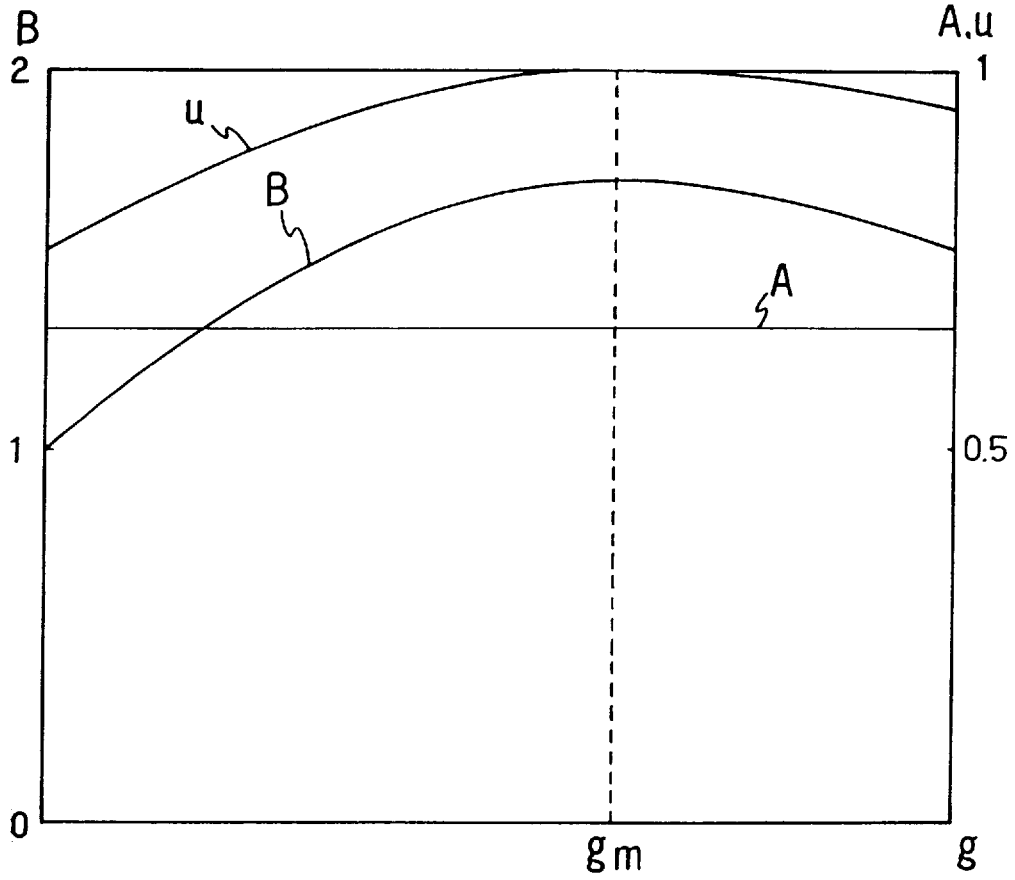
FIG. 3 is a graph showing the relationship between the distance between a scanning electrode and a maintaining electrode, and the brightness in the first embodiment of this invention.
Figure 13:
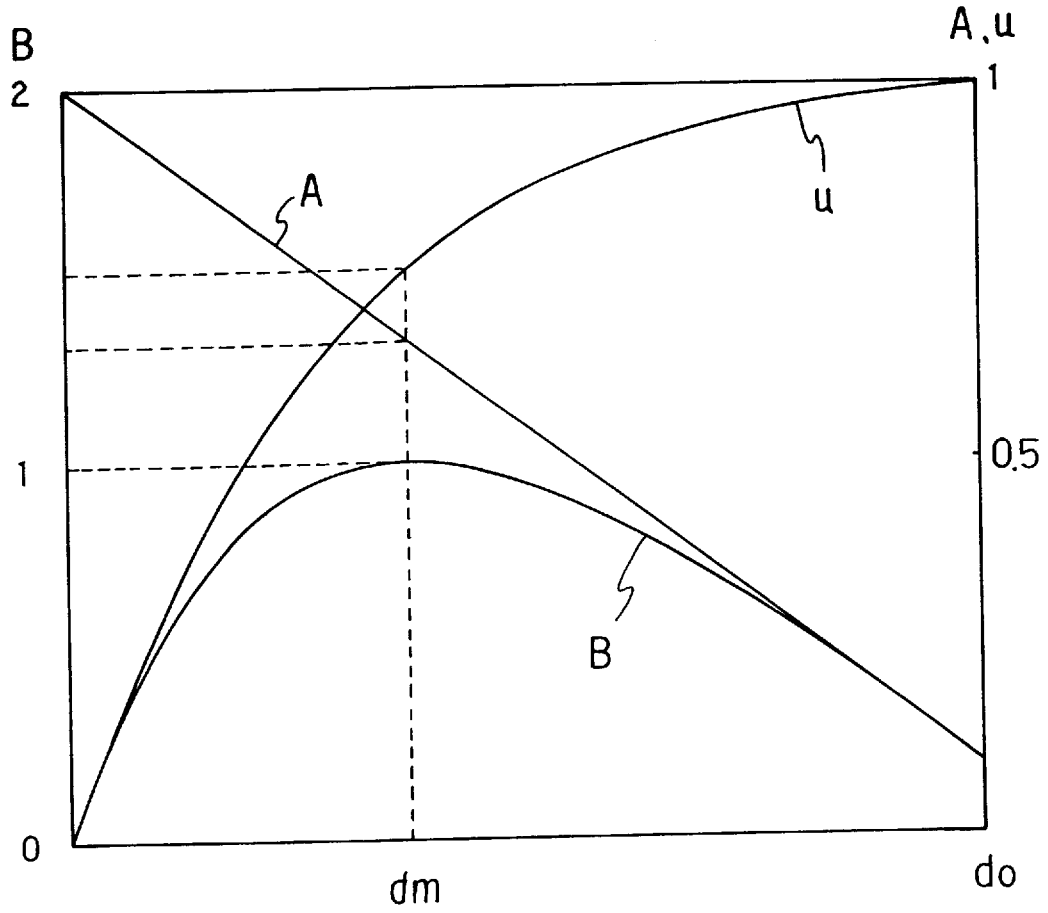
FIG. 13 (PRIOR ART)
FIG. 13 is a graph showing the relationship between the distance between a scanning electrode and a maintaining electrode, and the brightness in a first conventional example of this invention.
Figure 14:
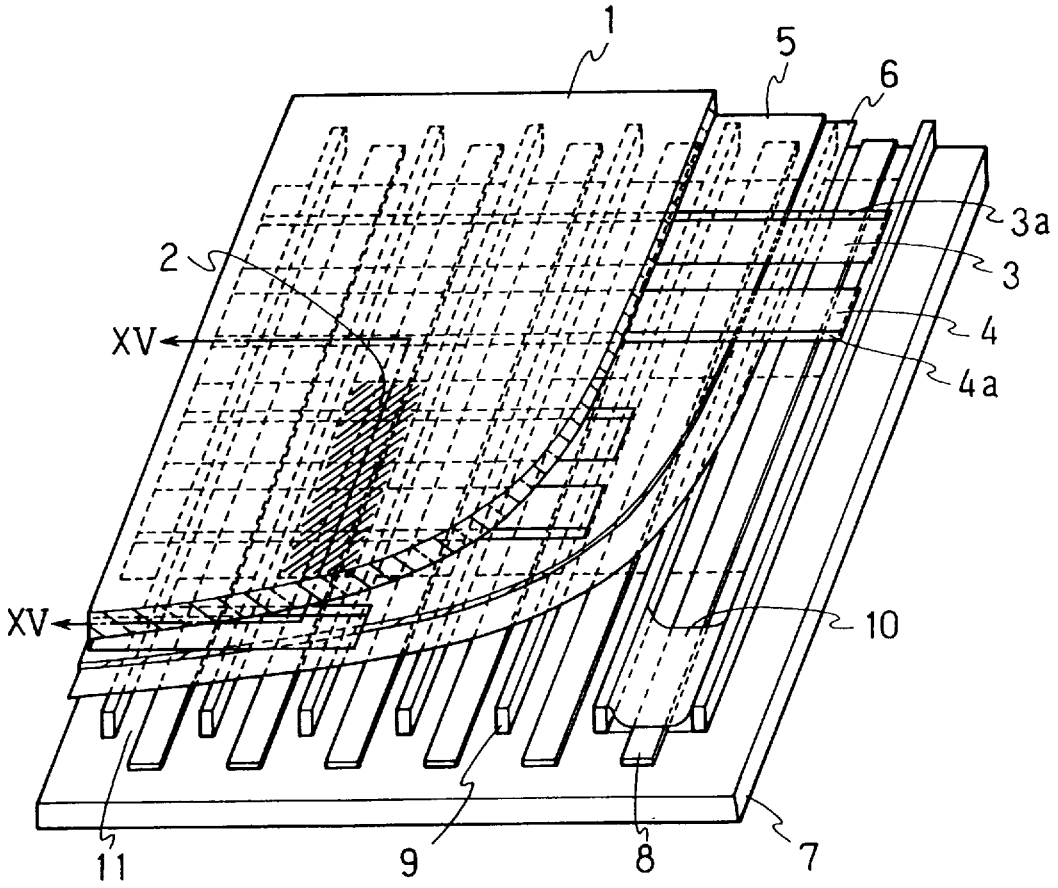
FIG. 14 (PRIOR ART)
FIG. 14 is a perspective view showing a second conventional example of an AC plasma display panel of this invention.
Figure 15:
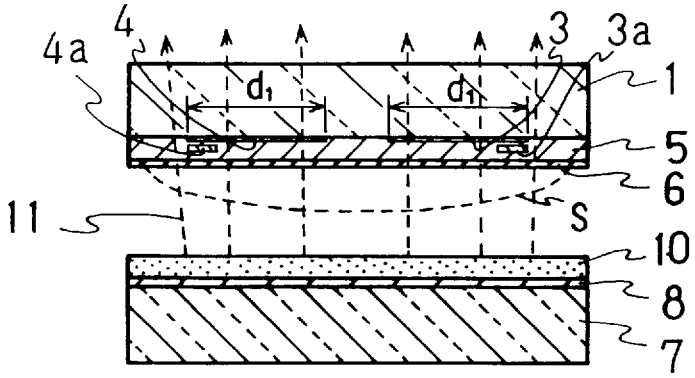
FIG. 15 (PRIOR ART)
FIG. 15 is a sectional view taken on line XV—XV of FIG. 14.

FIG. 3 is a graph showing the relationship between a distance, g, between scanning electrodes 3*b* and 3*c* and maintaining electrodes 4*b* and 4*c*, an amount of ultraviolet rays, u, opening ratio A of the panel and the brightness B of the panel. The scale used in FIG. 3 is a relative scale. When g is 0, the values of B, u and A are equivalent to the values of B, u and A of the conventional example when d is dm as shown in FIG. 13. According to the results shown in FIG.3, when g is gm, the brightness B of panel becomes maximum. The gm satisfies two conditions, such as d+gm is in a range between 200 μm and 2000 μm, and gm is in a range between d/2 and d. In this case, the brightness B of panel becomes about 1.7 times the value of the conventional example as shown in FIG. 13.

In addition, as explained in the conventional example, dm satisfies two conditions, such as dm+W is in a range between 200 μm and 2000 μm, and dm is in a range between p/5 and p/3. The width of an electrode of this embodiment, d, is dm/2. Therefore when dm of the above-mentioned formula is substituted by 2d, the width of the electrode d satisfies two conditions such as 2d+W is in a range between 200 μm and 2000 μm, and 2d is in a range between p/5 and p/3. In this case, W is in a range between 20 μm and 200 μm.

Figure 4:
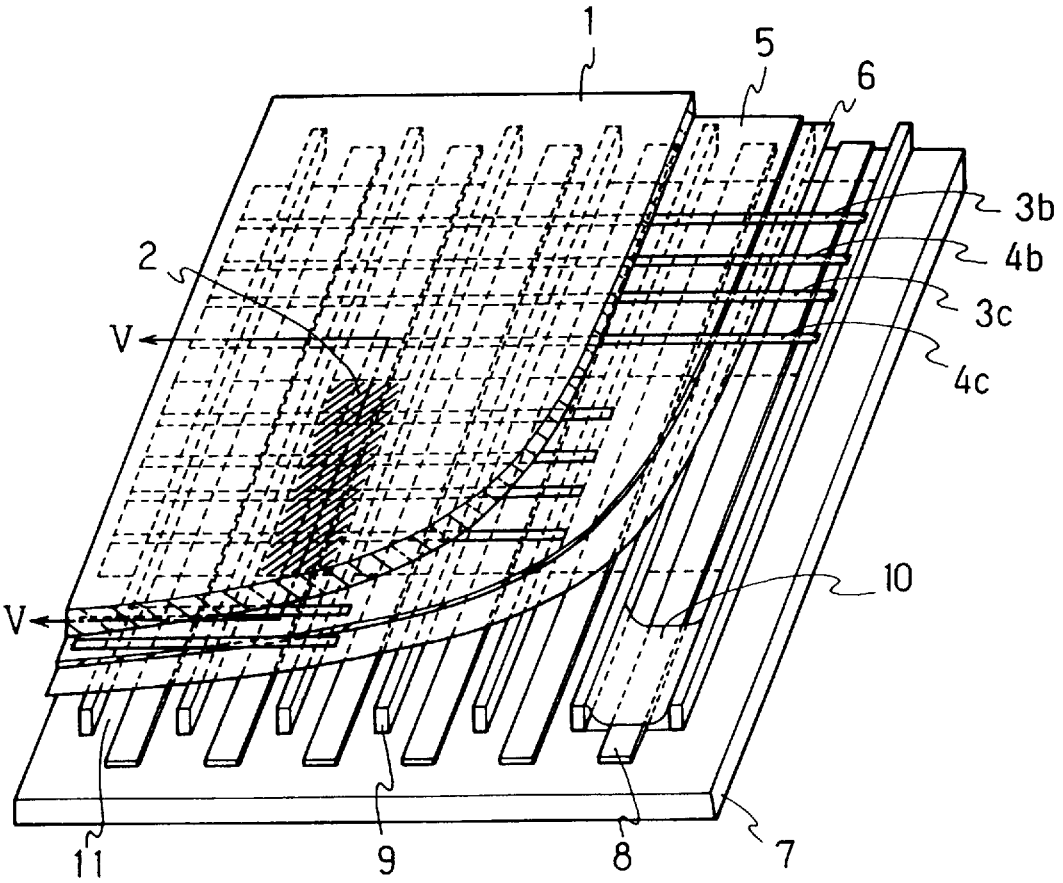
FIG. 4 is a perspective view showing a second embodiment of an AC plasma display panel of this invention.
Figure 5:
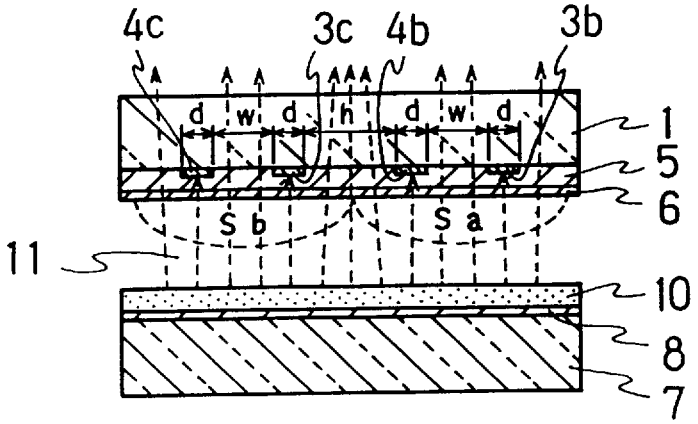
FIG. 5 is a sectional view taken on line V—V of FIG. 4.

Next, a second embodiment of the AC plasma display panel of this invention will be explained referring to FIGS. 4 to 6. Unlike the first embodiment of this invention, in the second embodiment of this invention, a discharge cell 2 formed on a first glass substrate comprises a group of electrodes in which a scanning electrode 3*b*, a maintaining electrode 4*b*, a scanning electrode 3*c* and a maintaining electrode 4*c* are arranged in that order. That is, a scanning electrode and a maintaining electrode are arranged alternately. The other aspects of the construction and operation as plasma display panel are the same as those of the first embodiment, and therefore an explanation about these is omitted. FIG. 5 is a sectional view taken on line V—V of a discharge cell of FIG. 4. A distance h between a scanning electrode 3*c* and a maintaining electrode 4*b* is set when W is in a range between 20 μm and 200 μm.

Next, a proper value of a distance h between a scanning electrode 3*c* and a maintaining electrode 4*b* will be described. As above-mentioned, the width of a scanning electrode 3*b*, 3*c* and a maintaining electrode 4*b* and 4*c, d*, is set to be dm/2. As shown in FIG. 5, when a distance h is widened, one discharge is generated at a region Sa by a scanning electrode 3*b* and a maintaining electrode 4*b*, and another discharge is generated at a region Sb by a scanning electrode 3*c* and a maintaining electrode 4*c*. That is, in a discharge cell 2, two maintaining discharge are generated at regions, Sa and Sb, a large amount of ultraviolet rays can be obtained and an amount of visible light emitted from the phosphor layer 10 is increased. In addition to that, even if a distance h is widened, the area of the scanning electrodes 3*c*, 3*b* and the maintaining electrodes 4*b* and 4*c* that interrupt the visible light are not changed. Consequently, the opening ratio A of panel is constant and the luminous brightness of the panel increases with a increase of the ultraviolet rays.

Figure 6:
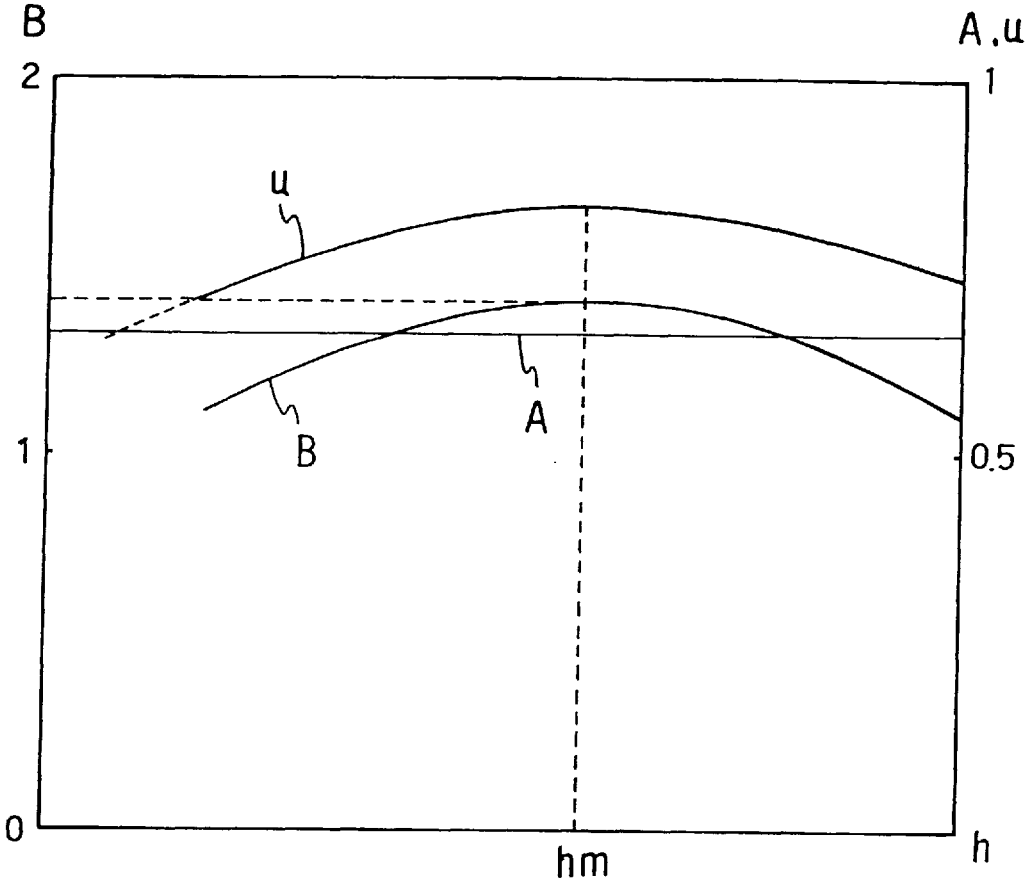
FIG. 6 is a graph showing the relationship between the distance between a scanning electrode and a maintaining electrode, and the brightness in a second embodiment of this invention.
Figure 10:
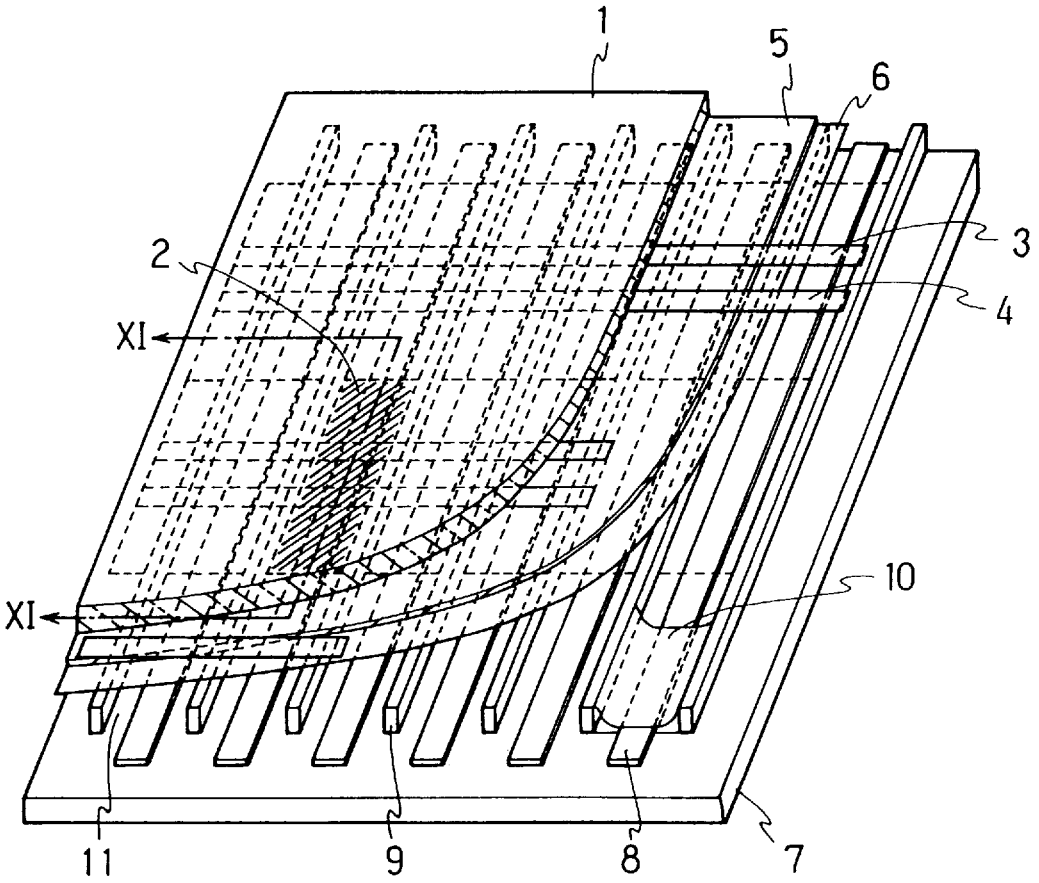
FIG. 10 (PRIOR ART)
FIG. 10 is a perspective view showing a first conventional example of the AC plasma display panel.

FIG. 6 is a graph showing the relationship between the distance h, the amount of ultraviolet rays u, the numerical aperture A of the panel and the brightness B of panel. The scale used in FIG. 6 is a relative scale, which is the same as that used in FIG. 3. According to the result shown in FIG. 6, when h is hm, the brightness of panel B becomes maximum. The hm is in a range between (d+W)/3 and (d+W)/2. In this case, the luminous brightness B of panel becomes 1.4 times the value of the conventional example as shown in FIG. 10.

In addition, as explained in the conventional example, dm satisfies two conditions, such as dm+W is in a range between 200 μm and 2000 μm, and dm is in a range between p/5 and p/3. The width of an electrode of this embodiment, d, is dm/2, therefore when dm of the above-mentioned formula is substituted by 2d, the width of the electrode d satisfies two conditions such as 2d+W is in a range between 200 μm and 2000 μm, and 2d is in a range between p/5 and p/3. In this case, W is in a range between 20 μm and 200 μm.

In the first and the second embodiments of this invention, a discharge cell comprises two scanning electrodes and two maintaining electrodes. In the first embodiment, the same effect can be obtained by arranging a pair or a plurality of pairs of electrodes consisting of a plurality of scanning electrodes at one side, and a plurality of maintaining electrodes whose number is the same as that of scanning electrodes at another side in a discharge cell 2. In the second embodiment, the same effect can be obtained by arranging a plurality of pairs of electrodes consisting of a scanning electrode and a maintaining electrode in which a position of the scanning electrode and the maintaining electrode are arranged alternately. In the second embodiment, the same effect can be obtained by arranging a pair or a plurality of pairs of electrodes consisting of four electrodes in which two scanning electrodes are arranged at outside and two maintaining electrodes are arranged at the inside in a discharge cell 2. In this case, an arrangement of electrodes may be reversed, that is, two maintaining electrodes may be arranged at outside ends and two scanning electrodes may be arranged at the inside.

Figure 7:
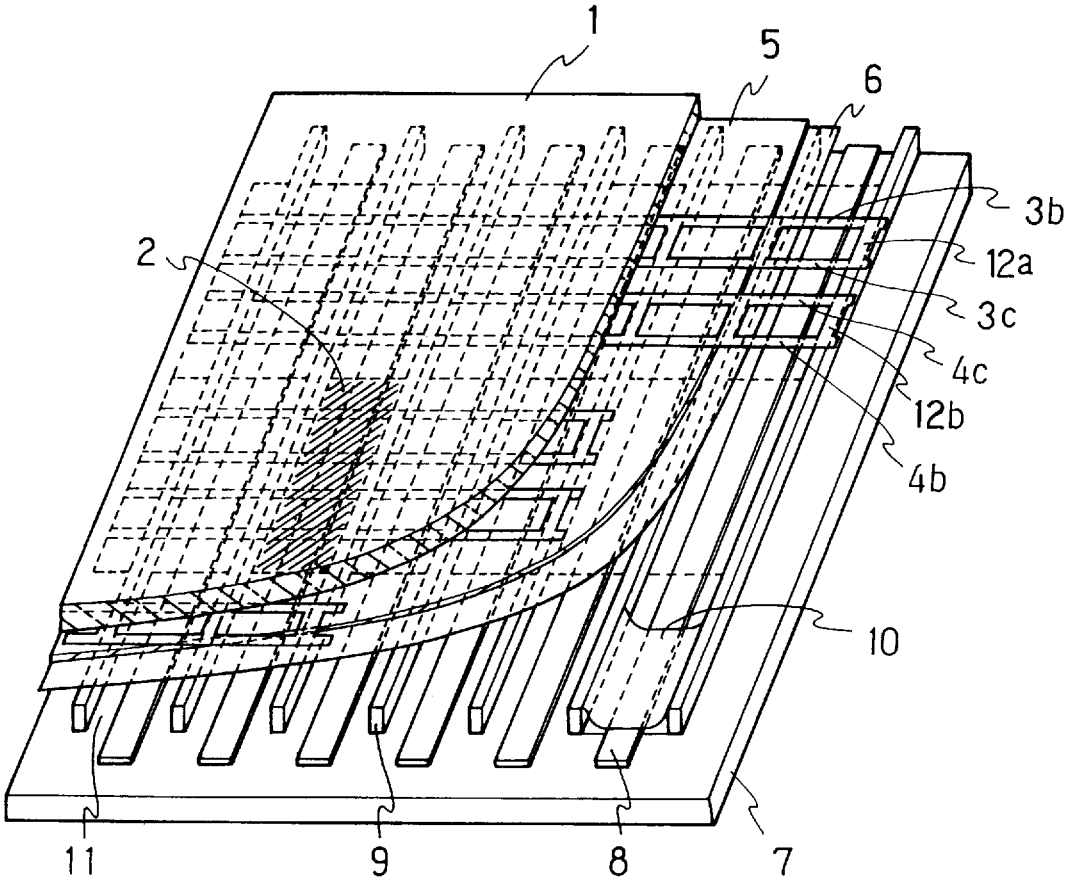
FIG. 7 is a perspective view showing a third embodiment of an AC plasma display panel of this invention.
Figure 8:
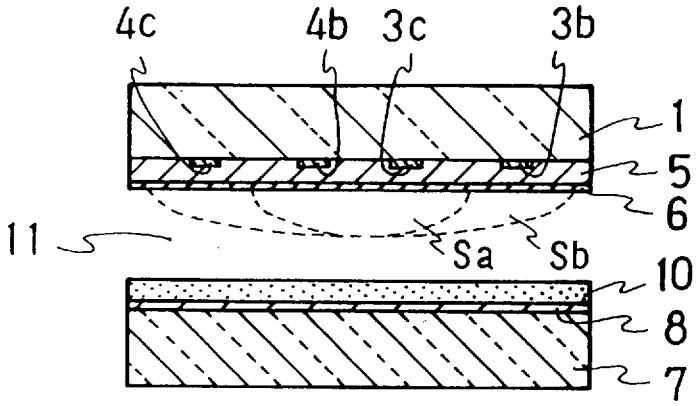
FIG. 8 is a sectional view taken on line III—III of FIG. 1.

Next, a third embodiment of this invention will be explained referring to FIGS. 7 to 9. FIG. 8 is a sectional view showing again a discharge cell 2 taken on line III—III of FIG. 1. As shown in FIG. 8, two scanning electrodes 3*b* and 3*c*, and two maintaining electrodes 4*b* and 4*c* are positioned separately. Consequently, at an initial stage of discharge, an electric field tends to be focused on the region between a pair of electrodes consisting of a scanning electrode 3*c* and a maintaining electrode 4*c*. Therefore, even at a final stage of discharge, the discharge of a discharge cell is limited to a narrow region Sa, and on the other hand, the discharge of a discharge cell is widened to region Sb. Therefore, when many discharge cells whose discharge regions are limited to Sa are generated, the brightness of panel is decreased, and when some discharge cells whose discharge regions are limited to Sa and other discharge cells whose discharge regions are limited to Sb are generated together, as a result, a brightness irregularity is occurred on the surface of the display panel.

An AC plasma display panel of this embodiment of this invention can solve the above-mentioned problems. In the AC plasma display panel of this embodiment of this invention as shown in FIG. 7, a discharge cell 2 comprises a group of four electrodes consisting of two scanning electrodes 3*b* and 3*c* arranged at one side, and two maintaining electrodes 4*b* and 4*c* arranged at another side and these two scanning electrodes 3*b* and 3*c* are connected electrically via a plurality of induction electrodes 12*a* at a position of rib 9, in the same way, these maintaining electrodes 4*b* and 4*c* are connected electrically via a plurality of induction electrodes 12*b* at a position of rib 9.

Figure 9:
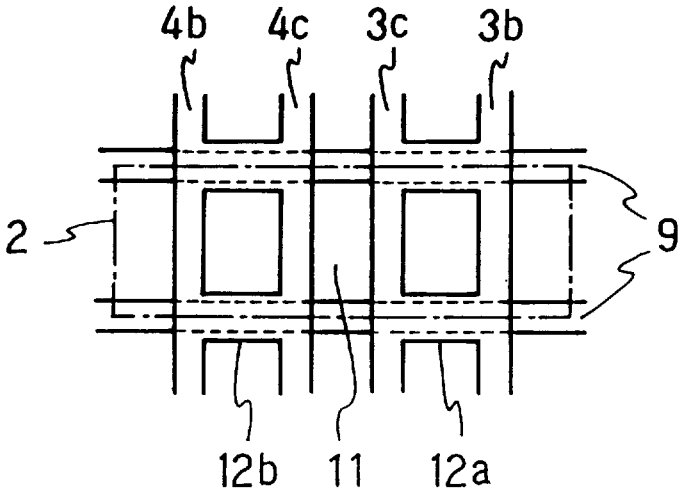
FIG. 9 is a plan view showing the scanning electrode and the maintaining electrode in the third embodiment of this invention.

FIG. 9 is a plan view showing a scanning electrode and a maintaining electrode. As shown in FIG. 9, the width of the induction electrode 12*a* and 12*b* is set to be slightly wider than that of a rib 9, and therefore, a portion of the induction electrode extends over to a discharge space 11. Consequently, an electric field between a scanning electrode 3*c* and a maintaining electrode 4*c* is equalized to an electric field between a scanning electrode 3*b* and a maintaining electrode 4*b* by the presence of the exposed portion of induction electrode 12*a* and 12*b*. As a result, at an initial stage of discharge, a discharge region is not limited to a narrow region Sa, and a reduction of brightness of panel and a brightness irregularity on the display panel can be prevented. In addition, it is not required to use an electrode in which a transparent conductor and an electrode bus are connected. Therefore, the number of production process steps and the production cost are not increased. In addition, in this embodiment of this invention, the discharge cell comprises two scanning electrodes and two maintaining electrodes, however, the same effect can be obtained by a discharge cell comprising more than three scanning electrodes and maintaining electrodes. In addition, in this embodiment of this invention, a pair of electrodes consisting of a scanning electrode and a maintaining electrodes are arranged, however, the same effect can be obtained by arranging a plurality of pairs of electrodes consisting of a scanning electrode and a maintaining electrode.

This invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, an all change which come within the meaning and range of equivalency of the claims are intended to be embraced therein.

What is claimed is:

1. An AC plasma display panel comprising first and second glass substrates that face each other and define a discharge space therebetween, a plurality of scanning electrodes and maintaining electrodes that are parallel to each other, formed on the first glass substrate, a dielectric layer that covers said scanning electrodes and said maintaining electrodes, and a plurality of ribs and data electrodes that are formed on the second glass substrate and arranged orthogonally to said scanning electrodes and said maintaining electrodes, wherein a discharge cell, which is formed by division of said discharge space by a pair of adjacent ribs, comprises said plurality of scanning electrodes and maintaining electrodes, wherein said scanning electrodes and said maintaining electrodes are opaque to visible light and said first glass substrate is provided at a display side of the panel.

2. The AC plasma display panel according to claim 1, wherein said plurality of scanning electrodes are provided at one side of each discharge cell and said plurality of maintaining electrodes whose number is the same as that of the scanning electrodes are provided at another side of each discharge cell.

3. The AC plasma display panel according to claim 2, wherein a distance W between an edge of a scanning electrode and an adjacent edge of an adjacent maintaining electrode is in a range between 20 $\mu$m and 200 $\mu$m.

4. The AC plasma display panel according to claim 3, wherein the discharge cell comprises four electrodes, a width of each electrode is shown as d, a width of a discharge cell is shown as p, 2d satisfies the conditions 2d+W is in a range between 200 $\mu$m and 2000 $\mu$m, and 2d is in a range between p/5 and p/3.

5. The AC plasma display panel according to claim 4, wherein a distance between an edge of one of said scanning electrodes and an adjacent edge of an adjacent scanning electrode, and a distance between an edge of one of said maintaining electrodes and an adjacent edge of an adjacent maintaining electrode is shown as g, g satisfies the conditions d+g is in a range between 200 $\mu$m and 2000 $\mu$m, and g is in a range between d/2 and d.

6. The AC plasma display panel according to claim 1, wherein the discharge cell comprises a plurality of pairs of electrodes consisting of one of said scanning electrodes and one of said maintaining electrodes in which said scanning electrodes and said maintaining electrodes are positioned alternately.

7. The AC plasma display panel according to claim 6, wherein, for a pair of electrodes comprising a scanning electrode and a maintaining electrode, a distance W between an edge of the scanning electrode and an edge of the adjacent maintaining electrode is in a range between 20 $\mu$m and 200 $\mu$m.

8. The AC plasma display panel according to claim 7, wherein two pairs of electrodes are provided for the discharge cell, a width of each electrode is shown as d and a width of a discharge cell is shown as p, and 2d satisfies the conditions 2d+W is in a range between 200 $\mu$m and 2000 $\mu$m, and 2d is in a range between p/5 and p/3.

9. The AC plasma display panel according to claim 8, wherein an inside distance h between an edge of a scanning electrode and an edge of an adjacent maintaining electrode is in a range between (d+W)/3 and (d+W)/2.

10. The AC plasma display panel according to claim 1, wherein the discharge cell comprises two outer electrodes that are said scanning electrodes and two inner electrodes that are said maintaining electrodes, or which comprises two outer electrodes that are said maintaining electrodes and two inner electrodes that are said scanning electrodes.

11. The AC plasma display panel according to claim 1, wherein the discharge cell comprises a plurality of scanning electrodes arranged at one side of a discharge cell and the same number of maintaining electrodes as those of scanning electrodes are arranged at another side of the discharge cell, and a plurality of induction electrodes which connect electrically with said plurality of scanning electrodes provided at one side of said discharge cell at a position of rib, and a plurality of induction electrodes which connect electrically with said plurality of maintaining electrodes provided at another side of said discharge cell at a position of the rib, with a portion of the induction electrodes extending over the discharge space.

12. The AC plasma display panel according to claim 1, wherein said maintaining electrodes and said data electrode are composed of Ag or a laminated conductor in which a Cu layer is sandwiched by Cr layers.

13. The AC plasma display panel according to claim 1, wherein a noble gas is sealed in said discharge space.

* * * * *